US009748633B2

(12) United States Patent
Chen et al.

(10) Patent No.: US 9,748,633 B2
(45) Date of Patent: Aug. 29, 2017

(54) ANTENNA STRUCTURE

(71) Applicant: Chiun Mai Communication Systems, Inc., New Taipei (TW)

(72) Inventors: Yi-Ting Chen, New Taipei (TW); Cho-Kang Hsu, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 219 days.

(21) Appl. No.: 14/011,925

(22) Filed: Aug. 28, 2013

(65) Prior Publication Data

US 2014/0118195 A1 May 1, 2014

(30) Foreign Application Priority Data

Oct. 26, 2012 (TW) ..... 101139597 A

(51) Int. Cl.

| | |
|---|---|
| ***H01Q 5/00*** | (2015.01) |
| ***H01Q 1/24*** | (2006.01) |
| ***H01Q 9/42*** | (2006.01) |
| ***H01Q 5/371*** | (2015.01) |
| ***H01Q 5/378*** | (2015.01) |

(52) U.S. Cl.

CPC ..... *H01Q 1/243* (2013.01); *H01Q 5/371* (2015.01); *H01Q 5/378* (2015.01); *H01Q 9/42* (2013.01)

(58) Field of Classification Search

CPC ..... H01Q 1/242; H01Q 1/243; H01Q 5/30; H01Q 5/307; H01Q 5/378; H01Q 1/2258; H01Q 1/2266; H01Q 1/2275; H01Q 1/24; H01Q 5/342; H01Q 5/371; H01Q 5/392; H01Q 9/42; H01Q 19/22; H01Q 19/28; H01Q 1/22; H01Q 1/241; H01Q 5/357; H01Q 5/364

USPC ..... 343/702

See application file for complete search history.

(56) References Cited

U.S. PATENT DOCUMENTS

| | | | | |
|---|---|---|---|---|
| 7,119,748 | B2 * | 10/2006 | Autti | H01Q 1/243 343/700 MS |
| 8,659,492 | B2 * | 2/2014 | Lee | H01Q 5/357 343/749 |
| 8,988,292 | B2 * | 3/2015 | Hotta | H01Q 1/243 343/700 MS |
| 2004/0137950 | A1 * | 7/2004 | Bolin et al. | 455/562.1 |

FOREIGN PATENT DOCUMENTS

| | | | |
|---|---|---|---|
| FI | WO 2010122220 A1 * | 10/2010 | H01Q 1/243 |
| JP | 2007-535836 A | 12/2007 | |
| WO | 2010122220 A1 | 10/2010 | |

* cited by examiner

*Primary Examiner* — Tho G Phan
*Assistant Examiner* — Patrick Holecek
(74) *Attorney, Agent, or Firm* — Steven Reiss

(57) ABSTRACT

An antenna structure includes a feed end, a ground end, a first radiator, a second radiator, and a third radiator. Both of the first radiator and the second radiator are connected to the feed end. The second radiator includes a first connection section and a second connection section. The third radiator is connected to the ground end, and includes a first coupling section separated from the first connection section and a second coupling section separated from the second connection section. A first gap is defined between the first coupling section and the first connection section; and a second gap is defined between the second coupling section and the second connection section.

16 Claims, 2 Drawing Sheets

ANTENNA STRUCTURE

BACKGROUND

1. Technical Field

The present disclosure relates to an antenna structure for a wireless communication device.

2. Description of Related Art

Antennas are found in many wireless communication devices such as mobile phones, for example. A wireless communication device may receive/transmit wireless signals having different frequencies, requiring the presence of a multiband antenna. However, many multiband antennas have complicated structures and are large in size, making it difficult to miniaturize wireless electronic devices.

Therefore, there is room for improvement within the art.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the disclosure. Moreover, in the drawings, like reference numerals designate corresponding parts throughout the views.

DETAILED DESCRIPTION

Figure 1:
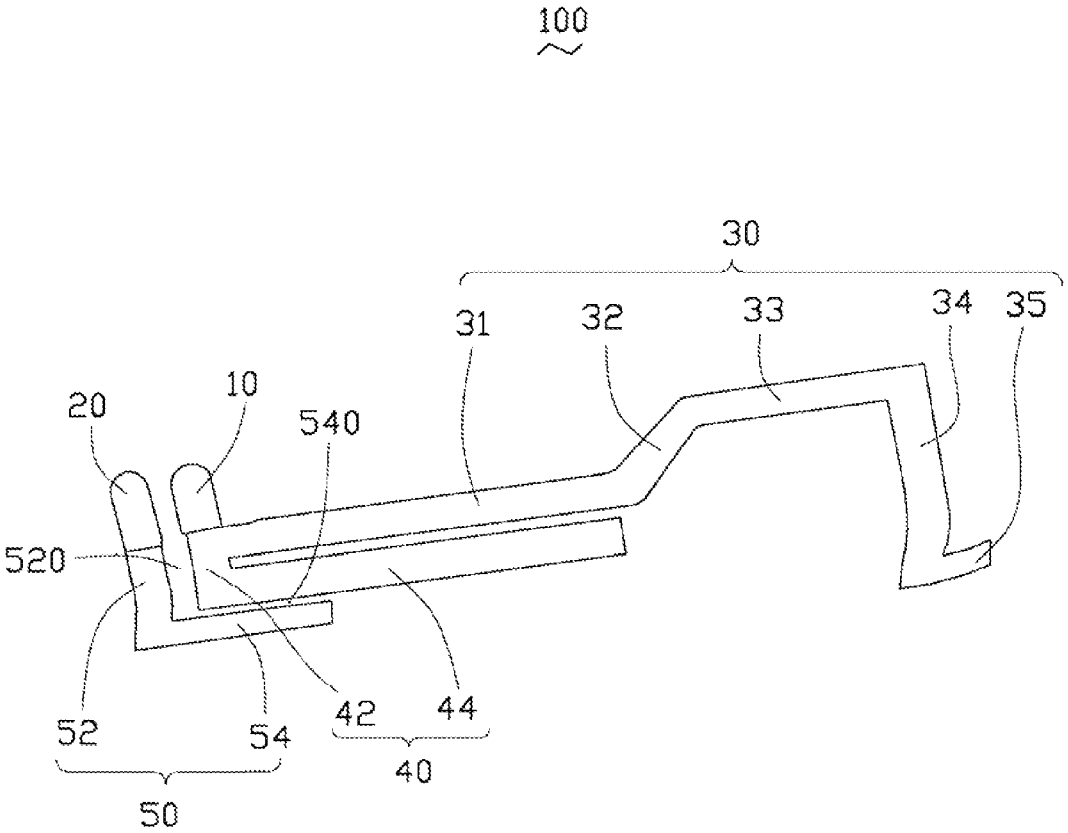
FIG. 1 is a schematic view of an antenna structure, according to an exemplary embodiment.

FIG. 1 shows an antenna structure 100, according to an exemplary embodiment. The antenna structure 100 is employed in a wireless communication device (not shown). The wireless communication device may be a mobile phone or a personal digital assistant, for example.

The antenna structure 100 includes a feed end 10, a ground end 20, a first radiator 30, a second radiator 40, and a third radiator 50.

The feed end 10 is configured to receive current from a printed circuit board (PCB) (not shown) of the wireless communication device, and provide the current to the antenna structure 100.

The ground end 20 is positioned coplanar with, and separate from, the feed end 10. The ground end 20 is configured to be electronically connected the PCB of the wireless communication device, and the antenna structure 100 is grounded through the ground end 20.

The first radiator 30 is connected to the feed end 10 and includes a first extending section 31, a second extending section 32, a third extending section 33, a fourth extending section 34, and a fifth extending section 35. In one exemplary embodiment, the first extending section 31, the second extending section 32, and the third extending section 33 are positioned coplanar with the feed end 10. The first extending section 31 is a substantially planar sheet that is perpendicularly connected to a side of the feed end 10. The second extending section 32 is connected between the first extending section 31 and the third extending section 33 at a set angle. The third extending section 33 is parallel to the first extending section 31. The fourth extending section 34 is a curved body perpendicular connected between a distal end of the third extending section 33 and the fifth extending section 35. The fifth extending section 35 is substantially perpendicular to a plane in which the feed end 10 is positioned.

The second radiator 40 is connected to the feed end 10, and is positioned coplanar with the feed end 10. The second radiator 40 includes a first connection section 42 and a second connection section 44. The first connection section 42 extends from an end of the feed end 10, and is perpendicularly connected to the first extending section 31. The second connection section 44 is perpendicularly connected to an end of the first connection section 42 that is opposite to the feed end 10, and extends parallel to the first extending section 31. In the exemplary embodiment, a length of the second connection section 44 is substantially equal to a length of first extending section 31.

The third radiator 50 is substantially L-shaped, and is connected to the ground end 20. The third radiator 50 includes a first coupling section 52 and a second coupling section 54. The first coupling section 52 extends from an end of the ground end 20, and is parallel to the first connection section 42. The first coupling section 52 is separated from the first connection section 42 to jointly define a first gap 520. The second coupling section 54 is connected to the first coupling section 52 via an arc, and extends towards to the second connection section 44. The second coupling section 54 is separated from the second connection section 44 to jointly define a second gap 540 that communicates with the first gap 520. In the exemplary embodiment, the second coupling section 54 is positioned on a plane that is substantially perpendicular to a plane in which the first coupling section 52 is positioned.

When current is input to the antenna structure 100 via the feed end 10, the first radiator 30 and the second radiator 40 obtain the current from the feed end 10. Thus, the first radiator 30 is activated for receiving and transmitting wireless signals having a first bandwidth of about 824-960 MHz (such as GSM 850/EGSM 900). In addition, the second radiator 40 is activated for receiving and transmitting wireless signals having a second bandwidth of about 1710-1990 MHz (such as DCS 1800/PCS 1900).

Figure 2:
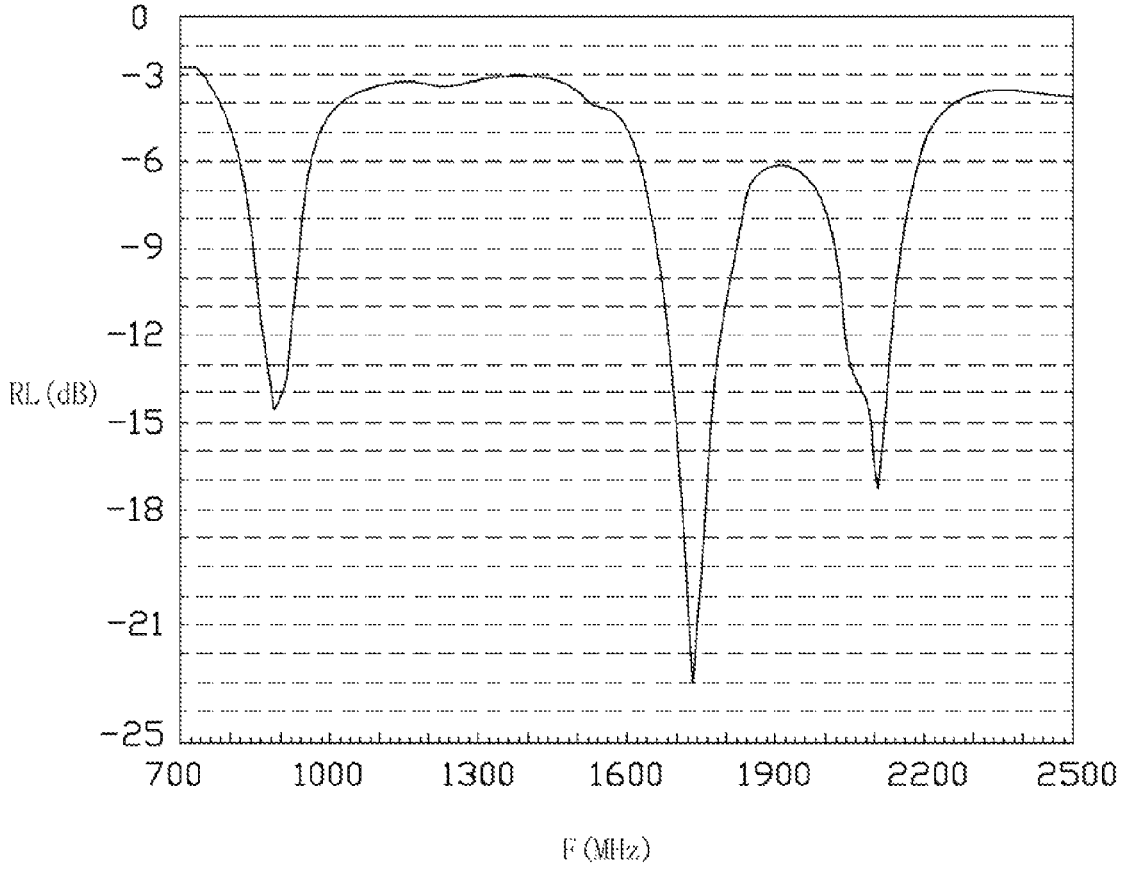
FIG. 2 is a return loss (RL) graph of the antenna structure shown in FIG. 1.

Additionally, the current is coupled from the second radiator 40 to the third radiator 50 via the first gap 520 and the second gap 540. Thus, the third radiator 50 is activated for receiving and transmitting wireless signals having a third bandwidth of about 1990-2170 MHz (such as UMTS Band I/II/V). Moreover, the first gap 520 and the second gap 540 cooperatively provide impedance matching for the second radiator 40 and the third radiator 50 to improve radiating performance of the antenna structure 100. FIG. 2 is a return loss (RL) graph of the antenna structure 100 of FIG. 1. The antenna structure 100 has good performance when operating at bandwidths of about 824-960 MHz, 1710-1990 MHz, and 1990-2170 MHz.

In other embodiments, the antenna structure 100 is a substantially planar sheet, and the feed end 10, the ground end 20, the first radiator 30, the second radiator 40, and the third radiator 50 are positioned coplanar with each other.

In summary, the antenna structure 100 includes at least two radiators, both the first radiator 30 and the second radiator 40 are connected to the feed end 10, the third radiator 50 is connected to the ground end 20, and current on the second radiator 40 can be coupled to the third radiator 50. Therefore, the antenna structure 100 is small in size and has good communication quality at a plurality of frequency bands used in wireless communications, which allows further size reductions of the wireless communication device employing the antenna structure 100.

It is to be understood, however, that even through numerous characteristics and advantages of the present disclosure have been set forth in the foregoing description, together with details of assembly and function, the disclosure is illustrative only, and changes may be made in detail, especially in the matters of shape, size, and arrangement of parts within the principles of the disclosure to the full extent indicated by the broad general meaning of the terms in which the appended claims are expressed.

What is claimed is:

1. An antenna structure, comprising:

a feed end;

a ground end separated from the feed end and coplanar with the feed end;

a first radiator connected to the feed end;

a second radiator connected to the feed end, and comprising a first connection section and a second connection section, the first connection section and the second connection section being coplanar with the feed end; and a third radiator connected to the ground end, and comprising a first coupling section coplanar with the ground end and a second coupling section;

wherein the first coupling section is separated from the first connection section, and a first gap is defined between the first coupling section and the first connection section; and wherein the second coupling section is separated from the second connection section, and a second gap is defined between the second coupling section and the second connection section; and wherein the first radiator comprises a first extending section, a second extending section, and a third extending section, the first extending section is perpendicularly connected to a side of the feed end, the second extending section is connected between the first extending section and the third extending section, the first extending section and the second extending section form a first angle therebetween, the third extending section and the second extending section form a second angle therebetween, the second angle is equal to the first angle, the first and second angles are between 90 degrees and 180 degrees, a length of the first extending section is substantially equal to that of the second connection section; and wherein a third gap is defined between the first extending section and the second connection section, and the second connection section is positioned between the first extending section and the second coupling section.

2. The antenna structure as claimed in claim 1, wherein the second gap communicates with the first gap, and the third gap is parallel to the second gap.

3. The antenna structure as claimed in claim 1, wherein the first radiator further comprises a fourth extending section, and a fifth extending section, the third extending section is parallel to the first extending section, the fourth extending section is a curved body connected between a distal end of the third extending section and the fifth extending section.

4. The antenna structure as claimed in claim 3, wherein the first extending section, the second extending section, and the third extending section are positioned coplanar with the feed end, and the fifth extending section is substantially perpendicular to a plane in which the feed end is positioned.

5. The antenna structure as claimed in claim 3, wherein the first connection section extends from an end of the feed end, and is perpendicularly connected to the first extending section.

6. The antenna structure as claimed in claim 5, wherein the second connection section is perpendicularly connected to an end of the first connection section that is opposite to the feed end, and extends parallel to the first extending section.

7. The antenna structure as claimed in claim 1, wherein the first coupling section extends from an end of the ground end, and is parallel to the first connection section.

8. The antenna structure as claimed in claim 7, wherein the second coupling section is positioned on a plane that is substantially perpendicular to a plane in which the first coupling section is positioned.

9. An antenna structure, comprising:

a feed end;

a ground end separated from the feed end and coplanar with the feed end;

a first radiator connected to the feed end;

a second radiator connected to the feed end, and comprising a first connection section and a second connection section, the first connection section and the second connection section being coplanar with the feed end;

a third radiator connected to the ground end, and comprising a first coupling section separated from the first connection section and coplanar with the ground end, and a second coupling section separated from the second connection section;

wherein the first radiator receives current from the feed end to receive and transmit wireless signals having a first bandwidth, and the second radiator receives current from the feed end to receive and transmit wireless signals having a second bandwidth; and wherein the current on the second radiator is coupled to the third radiator, to allow the third radiator to receive and transmit wireless signals having a third bandwidth; and wherein the first radiator comprises a first extending section, a second extending section, and a third extending section, the first extending section is perpendicularly connected to a side of the feed end, the second extending section is connected between the first extending section and the third extending section, the first extending section and the second extending section form a first angle therebetween, the third extending section and the second extending section form a second angle therebetween, the second angle is equal to the first angle, the first and second angles are between 90 degrees and 180 degrees, a length of the first extending section is substantially equal to that of the second connection section; and wherein a first gap is defined between the first coupling section and the first connection section; a second gap is defined between the second coupling section and the second connection section, and the second gap communicates with the first gap, a third gap is defined between the first extending section and the second connection section, and the third gap is parallel to the second gap, the second connection section is positioned between the first extending section and the second coupling section.

10. The antenna structure as claimed in claim 9, wherein the first radiator further comprises a fourth extending section, and a fifth extending section, the third extending section is parallel to the first extending section, the fourth extending section is a curved body connected between a distal end of the third extending section and the fifth extending section.

11. The antenna structure as claimed in claim 10, wherein the first extending section, the second extending section, and the third extending section are positioned coplanar with the feed end, and the fifth extending section is substantially perpendicular to a plane in which the feed end is positioned.

12. The antenna structure as claimed in claim 10, wherein the first connection section extends from an end of the feed end, and is perpendicularly connected to the first extending section.

13. The antenna structure as claimed in claim 12, wherein the second connection section is perpendicularly connected to an end of the first connection section that is opposite to the feed end, and extends parallel to the first extending section.

14. The antenna structure as claimed in claim 9, wherein the first coupling section extends from an end of the ground end, and is parallel to the first connection section.

15. The antenna structure as claimed in claim 14, wherein the second coupling section is positioned on a plane that is substantially perpendicular to a plane in which the first coupling section is positioned.

16. An antenna structure, comprising:

a feed end;

a ground end separated from the feed end;

a first radiator connected to the feed end;

a second radiator connected to the feed end, and comprising a first connection section and a second connection section; and a third radiator connected to the ground end, and comprising a first coupling section and a second coupling section;

wherein the first coupling section is separated from the first connection section, and a first gap is defined between the first coupling section and the first connection section; and wherein the second coupling section is separated from the second connection section, and a second gap is defined between the second coupling section and the second connection section;

wherein the first radiator comprises a first extending section, a second extending section, and a third extending section, the first extending section is perpendicularly connected to a side of the feed end, the second extending section is connected between the first extending section and the third extending section, the first extending section and the second extending section form a first angle therebetween, the third extending section and the second extending section form a second angle therebetween, the second angle is equal to the first angle, the first and second angles are between 90 degrees and 180 degrees.

* * * * *